US010088236B2

(12) United States Patent
Kurisu et al.

(10) Patent No.: US 10,088,236 B2
(45) Date of Patent: Oct. 2, 2018

(54) HEARTH ROLL AND MANUFACTURING METHOD THEREFOR

(71) Applicants: NIPPON STEEL & SUMITOMO METAL CORPORATION, Tokyo (JP); TOCALO CO., LTD., Kobe-shi, Hyogo (JP)

(72) Inventors: Yasushi Kurisu, Tokyo (JP); Tatsuo Suidzu, Akashi (JP)

(73) Assignees: NIPPON STEEL & SUMITOMO METAL CORPORATION, Tokyo (JP); TOCALO CO., LTD., Kobe-shi (JP)

( * ) Notice: Subject to any disclaimer, the term of this patent is extended or adjusted under 35 U.S.C. 154(b) by 232 days.

(21) Appl. No.: 15/116,778

(22) PCT Filed: Oct. 2, 2015

(86) PCT No.: PCT/JP2015/078094

§ 371 (c)(1),
(2) Date: Aug. 4, 2016

(87) PCT Pub. No.: WO2016/052741

PCT Pub. Date: Apr. 7, 2016

(65) Prior Publication Data

US 2016/0348971 A1 Dec. 1, 2016

(30) Foreign Application Priority Data

Oct. 2, 2014 (JP) ..... 2014-204108

(51) Int. Cl.

| | |
|---|---|
| ***F27D 3/02*** | (2006.01) |
| ***B65H 27/00*** | (2006.01) |
| ***C23C 4/06*** | (2016.01) |
| ***C21D 9/56*** | (2006.01) |
| ***C23C 4/10*** | (2016.01) |
| ***C23C 4/18*** | (2006.01) |

(Continued)

(52) U.S. Cl.
CPC ..... *F27D 3/026* (2013.01); *B65H 27/00* (2013.01); *C21D 9/56* (2013.01); *C21D 9/563* (2013.01);

(Continued)

(58) Field of Classification Search
CPC .... C23C 4/10; C23C 4/11; C23C 4/06; C23C 4/18; C23C 22/24; C23C 28/00;

(Continued)

(56) References Cited

U.S. PATENT DOCUMENTS 3,310,423 A * 3/1967 Ingham, Jr. ..... B05B 7/203 118/302
4,988,538 A * 1/1991 Horvei ..... C23C 4/18 427/453

(Continued)

FOREIGN PATENT DOCUMENTS

EP 2 213 755 A1 8/2010
GB 1 451 113 9/1976

(Continued)

OTHER PUBLICATIONS

Laser remelting of plasma sprayed nanostructured Al2O3-TiO2 coatings at different laser power, Surface & Coatings Technology, Wang et al. 2010.*

(Continued)

*Primary Examiner* — Jason L Vaughan
(74) *Attorney, Agent, or Firm* — Birch, Stewart, Kolasch & Birch, LLP

(57) ABSTRACT

A hearth roll includes a base roll, a thermally sprayed coating formed on the base roll, and a modified coating formed on the thermally sprayed coating. The modified coating is formed by modifying a part or the whole of a surface of the thermally sprayed coating by melting and solidification of the thermally sprayed coating, by irradiating (Continued)

a part or the whole of the surface of the thermally sprayed coating with an energy beam. The thickness of the modified coating is from 2 to 20 μm, and the Vickers hardness HV of the modified coating is from 1.2 to 1.4 times larger than the Vickers hardness HV of the thermally sprayed coating.

10 Claims, 5 Drawing Sheets

(51) Int. Cl.

| | |
|---|---|
| ***C22C 29/02*** | (2006.01) |
| ***C23C 22/24*** | (2006.01) |
| ***C23C 28/00*** | (2006.01) |
| ***C22C 29/06*** | (2006.01) |
| ***F27B 9/30*** | (2006.01) |
| *F27B 9/28* | (2006.01) |

(52) U.S. Cl.
CPC ..... *C22C 29/02* (2013.01); *C22C 29/06* (2013.01); *C23C 4/06* (2013.01); *C23C 4/10* (2013.01); *C23C 4/18* (2013.01); *C23C 22/24* (2013.01); *C23C 28/00* (2013.01); *F27B 9/30* (2013.01); *B65H 2401/12* (2013.01); *B65H 2401/13* (2013.01); *B65H 2404/187* (2013.01); *B65H 2404/5322* (2013.01); *B65H 2701/173* (2013.01); *F27B 9/28* (2013.01)

(58) Field of Classification Search
CPC ..... F27D 3/026; B65H 27/00; C21D 9/56; C21D 9/563; C22C 29/02; C22C 29/06; F27B 9/30
USPC ..... 492/2, 16, 28, 40, 48, 49, 53, 5
See application file for complete search history.

(56) References Cited

U.S. PATENT DOCUMENTS

| | | | | |
|---|---|---|---|---|
| 5,137,792 | A | 8/1992 | Hodes et al. | |
| 5,576,069 | A * | 11/1996 | Chen | C23C 4/18 427/350 |
| 5,967,959 | A * | 10/1999 | Niemi | D21F 3/08 492/54 |
| 6,199,281 | B1 * | 3/2001 | Lee | C23C 2/00 29/895.21 |
| 6,933,061 | B2 * | 8/2005 | Nagaraj | C23C 4/18 416/241 B |
| 2010/0230874 | A1 | 9/2010 | Kurisu et al. | |
| 2014/0300064 | A1 * | 10/2014 | Inaba | B23K 15/00 279/128 |
| 2014/0302247 | A1 | 10/2014 | Inaba et al. | |
| 2015/0017430 | A1 * | 1/2015 | Matthaeus | C23C 4/02 428/335 |

FOREIGN PATENT DOCUMENTS

| | | | |
|---|---|---|---|
| JP | 61-113757 | A | 5/1986 |
| JP | 2-194118 | A | 7/1990 |
| JP | 7-145467 | A | 6/1995 |
| JP | 11-302819 | A | 11/1999 |
| JP | 3234209 | B2 | 12/2001 |
| JP | 2002-348677 | A | 12/2002 |
| JP | 2004-52036 | A | 2/2004 |
| JP | 2007-154261 | A | 6/2007 |
| JP | 2011-6743 | A1 | 1/2011 |
| JP | 2013-95974 | A | 5/2013 |
| JP | 2013-104126 | A | 5/2013 |
| WO | WO 2009/069829 | A1 | 6/2009 |

OTHER PUBLICATIONS

International Search Report for PCT/JP2015/078094 (PCT/ISA/210) dated Dec. 15, 2015.
Written Opinion of the International Searching Authority for PCT/JP2015/078094 (PCT/ISA/237) dated Dec. 15, 2015.
Exended European Seach Report dated Feb. 28, 2018, in European Patent Application No. 15847128.4
Mateos et al., "Tribological properties of plasma sprayed and laser remelted 75/25 $CR_3C_2$/NiCr coatings," Tribology International (2001), vol. 34, pp. 345-351.

* cited by examiner

HEARTH ROLL AND MANUFACTURING METHOD THEREFOR

TECHNICAL FIELD

The present invention relates to a hearth roll and a method of producing the same.

BACKGROUND ART

In metal sheet production facilities, especially in steel-making process lines, phenomena, such as slipping or meandering of a steel sheet and fouling or build-up on surfaces of conveyor rolls, occur when a steel sheet is conveyed by high speed rotation of conveyor rolls. Especially, since hearth rolls for continuous annealing furnaces convey a steel sheet in a high temperature state, the build-up tends to occur on surfaces of hearth rolls. The build-up is a phenomenon in which matters, such as iron or manganese oxide, on a surface of a steel sheet attach to surfaces of hearth rolls and grow. As the build-up proceeds, contaminating objects adhering to the surfaces of hearth rolls gradually grow, and form, for example, projections having diameters of about 100 μm. As a result, protruding shapes of the matters attaching to the surfaces of hearth rolls are transferred to the surface of the steel sheet, to generate recess-shaped defects (referred to as "transferred defects" or "picked-up defects"), as a result of which the quality of the steel sheet deteriorates, and, in addition, removal of matters attaching to roll surfaces is necessary at periodic maintenance, which is a factor that decreases the productivity.

In view of these, various proposals have been made with respect to means for suppressing attachment of contaminating objects to hearth roll surfaces, and, in particular, many of them relate to improvement of the material of a thermally sprayed coating on the surfaces of hearth rolls.

For example, Japanese Patent (JP-B) No. 3234209 discloses a method for producing a sliding member, the method enabling formation a sliding surface having superior anti-sticking properties. This method includes: irradiating a thermally sprayed coating provided on a base with a laser beam in a pattern such as in dots or in lines, thereby partly modifying the coating by heating and structural changes in parts of the coating; and causing laser-irradiated areas or laser-non-irradiated areas to be depressed to form oil pools, by, mainly, selective abrasion during finishing processing or sliding.

Further, Japanese Patent Application Laid-Open (JP-A) No. 2013-95974 discloses a method for forming a densified layer in a thermally sprayed coating, the method including irradiating the surface of a thermally sprayed coating with a high energy beam, thereby causing remelting and resolidification of a coating composition in a surface layer of the thermally sprayed coating and thereby densifying the surface layer.

However, even by utilizing the techniques disclosed in JP-B No. 3234209 and JP-A No. 2013-95974, it is difficult to sufficiently suppress the occurrences of the build-up on the surfaces of hearth rolls, and further improvements in build-up resistance have been desired.

SUMMARY OF INVENTION

Embodiments in the present specification mainly aim to provide a hearth roll capable of suppressing attachment of contaminating objects to its roll surface during conveyance of a sheet, and a method of producing the hearth roll.

According to an aspect in the present specification, a hearth roll is provided which includes a base roll, a thermally sprayed coating formed on the base roll, and a modified coating formed on the thermally sprayed coating, the modified coating being formed by modifying a part or the whole of a surface of the thermally sprayed coating by melting and solidification of the thermally sprayed coating, by irradiating a part or the whole of the surface of the thermally sprayed coating with an energy beam, the thickness of the modified coating being from 2 to 20 μm, and the Vickers hardness HV of the modified coating being from 1.2 to 1.4 times larger than the Vickers hardness HV of the thermally sprayed coating.

According to another aspect of the present specification, a method of producing a hearth roll is provided, the method including a step of irradiating a part or the whole of a surface of a thermally sprayed coating formed on a base roll with an energy beam, thereby modifying a part or the whole of the thermally sprayed coating by melting and solidification of the thermally sprayed coating, to form a modified coating having a thickness of from 2 to 20 μm and a Vickers hardness HV that is from 1.2 to 1.4 times larger than the Vickers hardness HV of the thermally sprayed coating.

DESCRIPTION OF EMBODIMENTS

Figure 1:
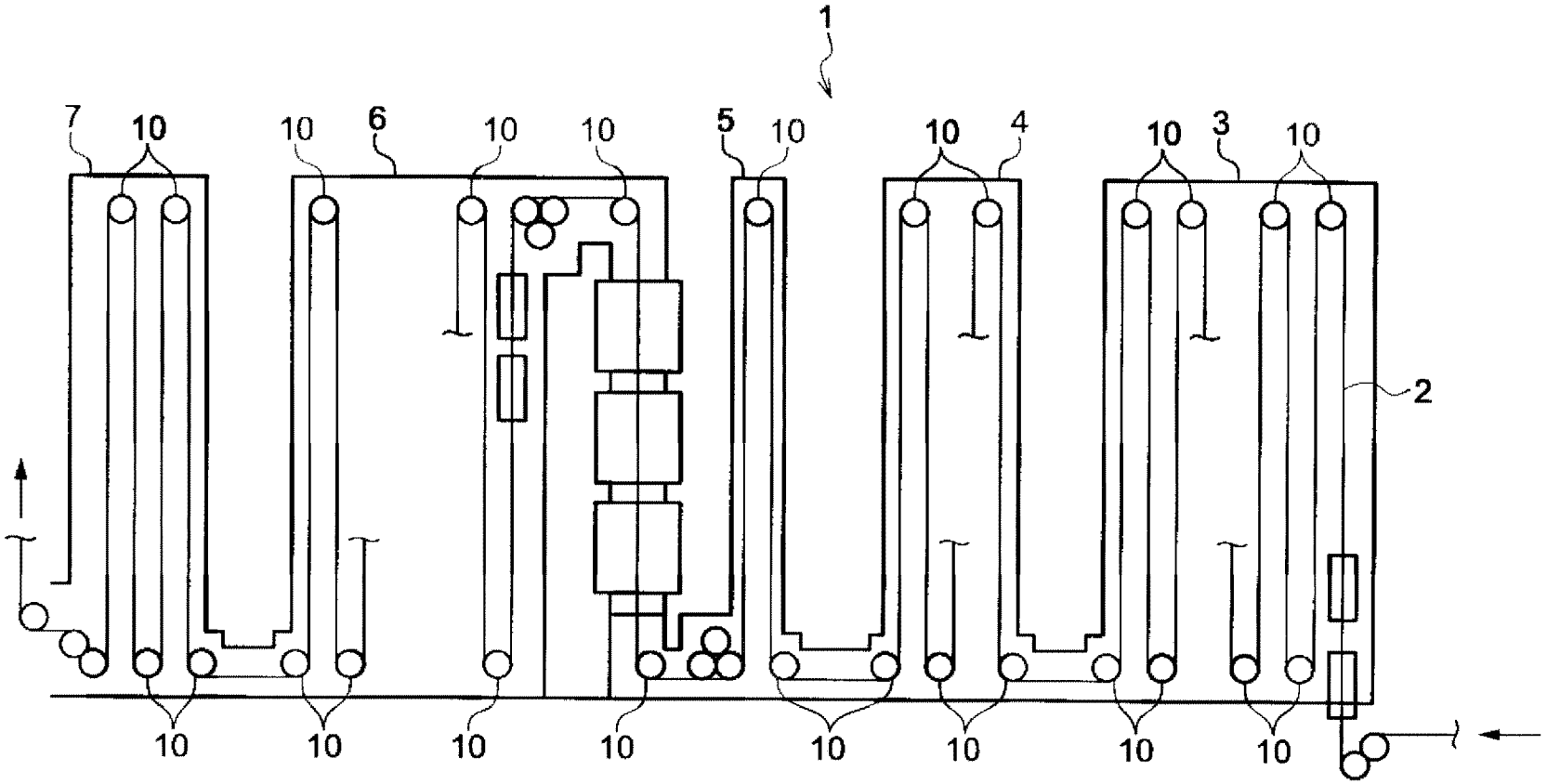
FIG. 1 is a schematic diagram illustrating an example of a continuous annealing furnace according to a first embodiment of the present specification.

According to an aspect of the invention:

(1) A hearth roll is provided which includes:

a base roll;

a thermally sprayed coating formed on the base roll; and a modified coating formed on the thermally sprayed coating, the modified coating being formed by modifying a part or the whole of a surface of the thermally sprayed coating by melting and solidification of the thermally sprayed coating, by irradiating a part or the whole of the surface of the thermally sprayed coating with an energy beam, the thickness of the modified coating being from 2 to 20 μm, and the Vickers hardness HV of the modified coating being from 1.2 to 1.4 times larger than the Vickers hardness HV of the thermally sprayed coating.

(2) In the hearth roll according to (1), preferably, cracks are present on a surface of the modified coating, and the average spacing between adjacent cracks in a cross-section of the hearth roll cut in the thickness direction is from 10 to 100 μm, and the opening widths of the cracks are less than 5 μm.

(3) In the hearth roll according to (1) or (2), preferably, the modified coating includes from 0.5 to 2% by mass of oxygen.

(4) In the hearth roll according to any one of (1) to (3), preferably, $Al_2O_3$ is present in a dispersed state in a surface of the modified coating, and the proportion of the area of $Al_2O_3$ in the surface of the modified coating is from 5 to 40%.

(5) The hearth roll according to any one of (1) to (4) preferably further includes a chromium oxide layer formed on the modified coating, or on the modified coating and the thermally sprayed coating.

(6) In the hearth roll according to any one of (1) to (5), preferably, the thermally sprayed coating is a cermet coating consisting of a heat-resistant alloy and a ceramic, wherein the ceramic including, in terms of % by volume, $Cr_3C_2$ at from 50 to 90%, $Al_2O_3$ at from 1 to 40%, $Y_2O_3$ at from 0 to 3%, and $ZrB_2$ at from 0 to 40%, and the balance being composed of impurities and pores, the heat-resistant alloy including, in terms of % by mass, Cr at from 5 to 20%, Al at from 5 to 20%, and at least one of Y or Si at from 0.1 to 6%, and the balance being composed of at least one of Co or Ni and impurities, and from 50 to 90% by volume of the cermet coating being the ceramic, and the balance being the heat-resistant alloy.

(7) In the hearth roll according to (6), preferably, the heat-resistant alloy further includes, in terms of % by mass, at least one of Nb at from 0.1 to 10% or Ti at from 0.1 to 10%.

According to another aspect of the invention:

(8) A method of producing a hearth roll is provided which includes a step of irradiating a part or the whole of a surface of a thermally sprayed coating formed on a base roll with an energy beam, thereby modifying a part or the whole of the surface of the thermally sprayed coating by melting and solidification of the thermally sprayed coating, to form a modified coating having a thickness of from 2 to 20 μm and a Vickers hardness HV that is from 1.2 to 1.4 times larger than the Vickers hardness HV of the thermally sprayed coating.

(9) In the method of producing a hearth roll according (8), preferably, irradiation with the energy beam is performed in the atmosphere.

(10) In the method of producing a hearth roll according to (8) or (9), preferably, a chromate treatment is performed after the modified coating is formed.

Favorable embodiments in the present specification will be described in detail below, with reference to the attached drawings. In the present specification and the drawings, elements having substantially the same function and structure are denoted by the same reference character, and repeated explanation thereof is omitted.

(Configuration of Continuous Annealing Furnace)

First, a continuous annealing furnace to which the hearth roll for a continuous annealing furnace according to a first embodiment of the present specification is applied is described with reference to FIG. 1.

As illustrated in FIG. 1, a continuous annealing furnace 1 is machinery configured to continuously anneal a strip-shaped steel sheet 2 in order to adjust the mechanical properties (such as hardness) of the steel sheet 2 produced in a cold rolling process. The continuous annealing furnace 1 applies a heat cycle including heating, soaking, cooling, and the like to the steel sheet 2 as the steel sheet 2 passes through sections between plural rolls placed in the furnace, thereby continuously subjecting the steel sheet 2 to continuous annealing. Here, the steel sheet 2 is an example of a metal strip that is to be annealed, and is, for example, a thin sheet that has been cold rolled by continuous cold-rolling machinery not shown in the figure (for example, a cold-rolled strip-shaped steel sheet having a sheet thickness of from 0.14 mm to 3.2 mm). The metal strip is not limited with respect to its material, insofar as the metal strip is a strip-shaped metal material (metal strip) that is to be annealed.

As illustrated in FIG. 1, the continuous annealing furnace 1 includes, for example, a heating zone 3, a soaking zone 4, a primary cooling zone 5, an overaging zone 6, and a secondary cooling zone 7 disposed in this order from the entry-side. The continuous annealing furnace 1 continuously anneals the steel sheet 2 while conveying the steel sheet 2 using plural hearth rolls 10 for a continuous annealing furnace provided in each zone. Although not illustrated in the figure, the upstream of the heating zone 3 is provided with, for example, a pay-off reel, a shear, an entry-side cleaning apparatus, an entry-side looper and the like, and the downstream of the secondary cooling zone 7 is provided with, for example, a water cooling tank, a skin pass roll, an exit-side looper, a trimmer, a coiler and the like.

The heating zone 3 heats the steel sheet 2 to a high temperature of, for example, from 700 to 900° C. by using a heating method such as direct-fired oxidation-free heating or radiation tube heating. The soaking zone 4 conducts heat treatment to maintain the steel sheet 2 at a prescribed temperature, using a heating method such as radiation tube heating or indirect electric heating. The primary cooling zone 5 rapidly cools the steel sheet 2, using a cooling method such as roll contact cooling, gas jet cooling or mist cooling. The overaging zone 6 conducts overaging treatment in which the steel sheet 2 is maintained at a prescribed temperature for a prescribed time period (for example, at from 300 to 400° C. for 3 min) by using, for example, an electric heater. Further, the secondary cooling zone 7 cools the steel sheet 2 after the overaging treatment, using any of the various cooling systems described above.

As described above, the continuous annealing furnace 1 adjusts the mechanical properties of the steel sheet 2 by applying a prescribed heat cycle to the steel sheet 2 by causing the steel sheet 2 to continuously pass through the plural furnaces. In this process, the heat cycle is set so as to satisfy the annealing conditions that are in accordance with the quality of the steel sheet to be produced (such as a high-tensile steel sheet, a general cold-rolled steel sheet, a tin-plated steel sheet, or a steel sheet for drawing).

(Configuration of Hearth Roll)

Next, the hearth roll for a continuous annealing furnace according to the present embodiment will be described with reference to FIG. 2A to FIG. 4.

Figure 2A:
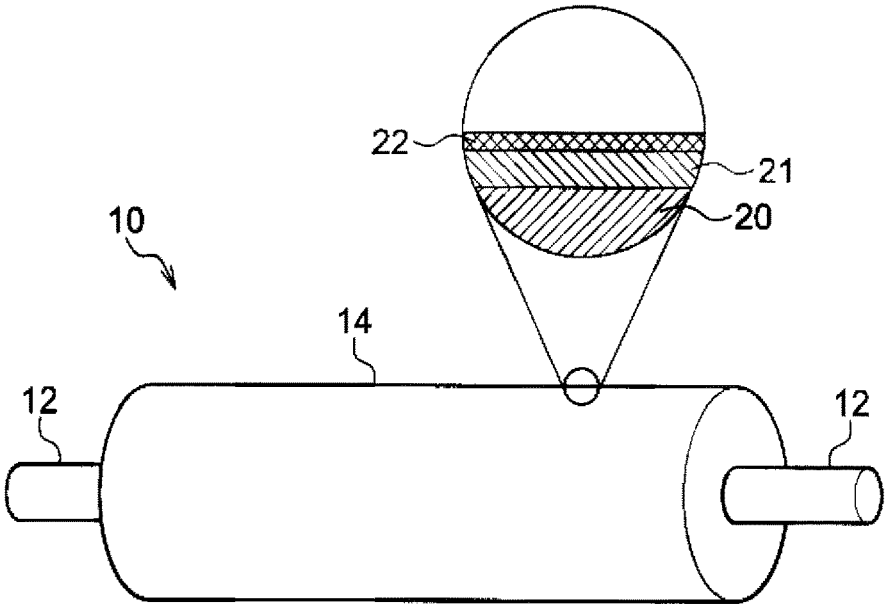
FIG. 2A is a perspective view and an enlarged partial cross-sectional view illustrating a hearth roll for a continuous annealing furnace according to the first embodiment.

As illustrated in FIG. 2A, the hearth roll 10 for a continuous annealing furnace (hereinafter also referred to simply as "hearth roll 10") includes a roll shaft 12 and a roll barrel 14 mounted on the roll shaft 12. The hearth roll 10 has a roll width that is greater than the width of the steel sheet 2 supplied into the continuous annealing furnace 1, and the roll width of the roll barrel 14 is, for example, from about 1,000 mm to about 2,500 mm, and the roll diameter ϕ of the roll barrel 14 is, for example, from about 600 mm to about 1,000 mm. The hearth roll 10 is a drive roll, and functions as a steel sheet conveyor roll configured to convey the steel sheet 2 in the continuous annealing furnace 1. More specifically, when the circumferential surface of the roll barrel 14 (hereinafter sometimes also referred to as "roll circumferential surface") contacts the steel sheet 2 while the hearth roll 10 rotates around the roll shaft 12, the hearth roll 10 conveys the steel sheet 2 while changing the travelling direction of the steel sheet 2 wound around the roll barrel 14 at a prescribed winding angle.

Figure 2B:
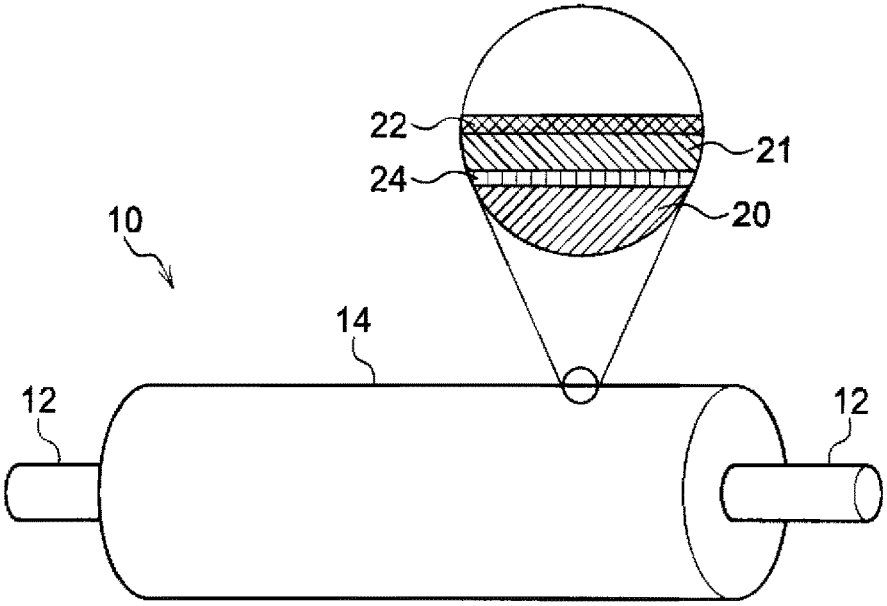
FIG. 2B is a perspective view and an enlarged partial cross-sectional view illustrating a hearth roll for a continuous annealing furnace according to the first embodiment.

Further, as illustrated in FIG. 2A, the roll barrel 14 of the hearth roll 10 includes a base roll 20, a thermally sprayed coating 21 formed on the surface of the base roll 20, and a modified coating 22, which is the outermost coating formed on the surface of the thermally sprayed coating 21. Further, as illustrated in FIG. 2B, an undercoat layer 24 may be formed between the base roll 20 and the thermally sprayed coating 21, if necessary, by undercoat thermal spraying of only a heat-resistant alloy, in order to prevent separation due to a difference in thermal expansion coefficients.

The base roll 20 is made of a metal such as steel and configures the basic shape of the hearth roll 10. For the base roll 20, for example, stainless-steel-based heat-resistant cast steel is used, and, particularly, SCH22 is most suitable. The base roll 20 is subjected to coating treatment such as thermal spraying. In the present embodiment, a thermally sprayed coating 21 is formed on the surface of the base roll 20, and a modified coating 22 is further formed on the surface of the thermally sprayed coating 21.

The thermally sprayed coating 21 is formed by thermal spraying of a thermal spray material onto the surface of the base roll 20, the thermal spray material being a material in which a heat-resistant alloy and a ceramic are combined (cermet material). The material of the thermally sprayed coating 21 will be described in detail below. Although the thickness of the thermally sprayed coating 21 (thickness $d_1$ in FIG. 3A) is not particularly limited, the thickness of the thermally sprayed coating 21 is, for example, from 20 to 200 μm.

The hardness of the thermally sprayed coating 21 is preferably from 600 to 1,000 in terms of Vickers hardness HV as defined in ISO 6507-1. A Vickers hardness HV of the thermally sprayed coating 21 of less than 600 is not favorable because contaminating objects such as iron that are the source of build-up tend to bite into the thermally sprayed coating 21 and build-up tends to occur. In contrast, when the Vickers hardness HV of the thermally sprayed coating 21 is from 600 to 1,000, the biting of contaminating objects such as iron into the hard thermally sprayed coating 21 can be suppressed, and, therefore, the occurrence of build-up can be suppressed. A Vickers hardness HV of the thermally sprayed coating 21 of more than 1,000 is not favorable since the thermally sprayed coating 21 becomes to have a tendency to crack and detach. The Vickers hardness HV is measured according to the test method as defined in ISO 6507-1.

On the thermally sprayed coating 21, a modified coating 22 is provided; the modified coating 22 is formed by remelting the thermal spray material that forms the thermally sprayed coating 21, and then solidifying the thermal spray material. The modified coating 22 has a small surface roughness and is a dense coating, and the modified coating 22 has a porosity of almost 0%.

The thickness of the modified coating 22 (thickness $d_2$ in FIG. 3A) is preferably from 2 to 20 μm. A thickness of the modified coating 22 of less than 2 μm is not favorable because the possibility that the modified coating 22 is worn by abrasion during conveyance of the steel sheet 2 becomes high. A thickness of the modified coating 22 of more than 20 μm is not favorable because the modified coating 22 becomes to have a tendency to detach.

The thicknesses of the thermally sprayed coating 21 and the modified coating 22 can be measured by observing a cross-section of the produced hearth roll 10 using a microscope such as a scanning electron microscope (SEM).

The Vickers hardness HV of the modified coating 22 according to the present embodiment is preferably from 1.2 to 1.4 times larger than the Vickers hardness HV of the thermally sprayed coating 21. Since the Vickers hardness HV of the thermally sprayed coating 21 is, for example, from about 600 to about 1,000, the Vickers hardness HV of the modified coating 22 according to the present embodiment would be from about 720 to about 1,400. Since the modified coating 22 has a hardness that is higher than the hardness of the thermally sprayed coating 21, biting of contaminating objects such as iron into the modified coating 22 can more effectively be prevented, and, therefore, the occurrence of build-up can be suppressed. When the hardness ratio in terms of Vickers hardness Hv is lower than 1.2, biting of contaminating objects such as iron into the modified coating 22 tends to occur, and build-up tends to occur. When the hardness ratio in terms of Vickers hardness Hv is higher than 1.4, the modified coating 22 tends to detach.

Figure 3A:
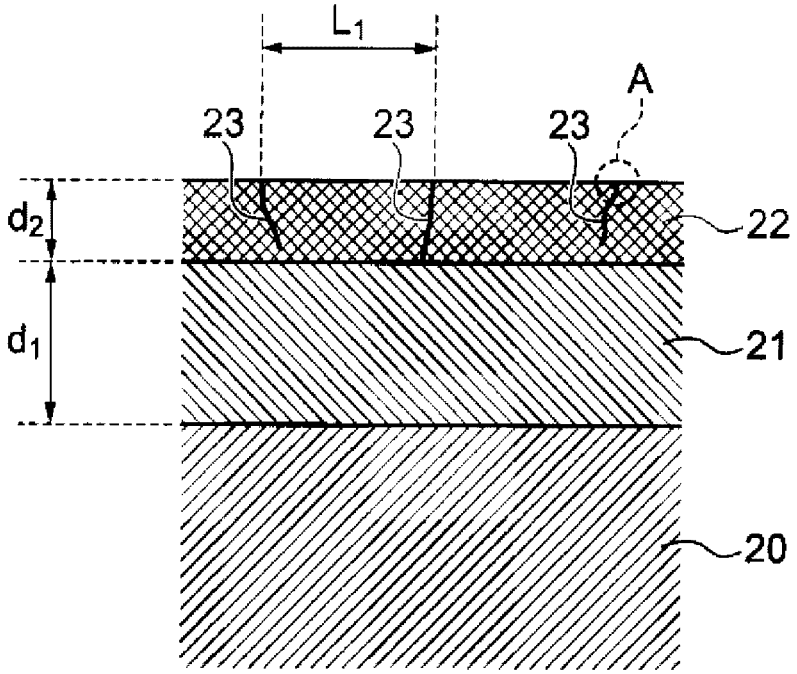
FIG. 3A is an enlarged partial cross-sectional view illustrating a hearth roll for a continuous annealing furnace according to the first embodiment.
Figure 3B:
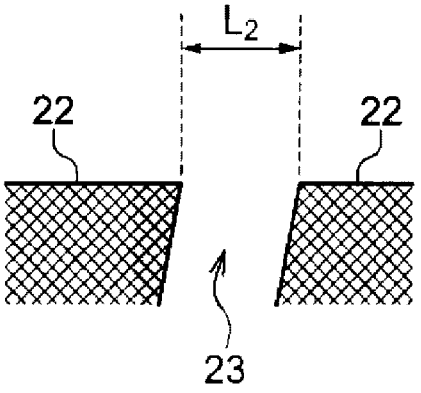
FIG. 3B is an enlarged partial cross-sectional view illustrating a hearth roll for a continuous annealing furnace according to the first embodiment.
Figure 4:
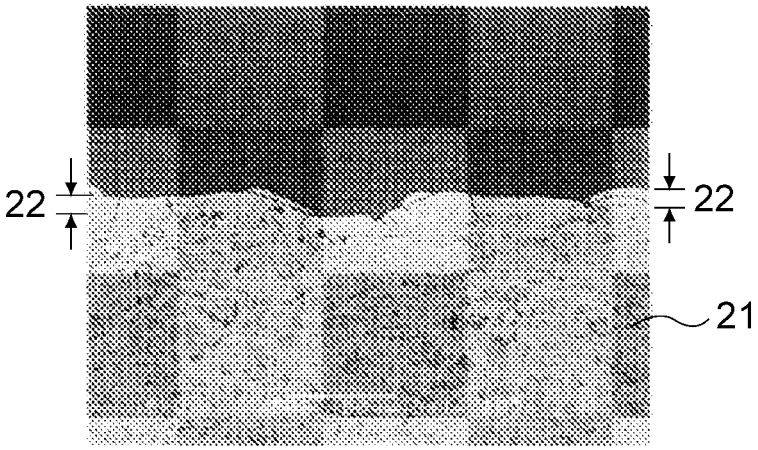
FIG. 4 is an example of a scanning electron microscope (SEM) micrograph of a thermally sprayed coating and a modified coating of a hearth roll for a continuous annealing furnace according to the first embodiment.

As schematically illustrated in FIG. 3A, cracks 23 are present in the surface of the modified coating 22 at a prescribed spacing. When cracks 23 are present in the modified coating 22, the cracks 23 function as a stress relaxation mechanism to prevent fracture or detachment of the modified coating 22 caused by a thermal stress. The spacing $L_1$ between adjacent cracks 23 in a cross-section of the hearth roll cut in the thickness direction. such as that illustrated in FIG. 3A, is preferably from 10 to 100 μm. The opening width of the crack 23 (distance $L_2$ indicated in FIG. 3B) is preferably less than 5 μm. A spacing $L_1$ of less than 10 μm is not favorable because the modified coating 22 becomes to have tendency to detach. When the spacing $L_1$ is more than 100 μm, the possibility that the opening width $L_2$ of the crack 23 is 5 μm or more becomes high. When the opening width $L_2$ of the crack 23 is 5 μm or more, contaminating objects, such as iron, serving as the source of build-up tend to bite in the opening, and, therefore, it becomes difficult to suppress the occurrence of build-up. The opening width $L_2$ of the crack 23 is preferably as small as possible, and the lower limit thereof is not particularly determined. However, from the viewpoint of the production of the modified coating 22, an opening width $L_2$ of 0.1 μm would be the minimum value possible.

The method employed for measuring the spacing $L_1$ between adjacent cracks 23 or the opening width $L_2$ of the crack is not particularly limited, and can be measured using known methods. For example, a cross-section of the produced hearth roll 10 may be enlarged to a magnification suitable for observation by using a microscope such as a SEM, and the spacing between adjacent cracks 23 and the opening widths of the cracks 23 may be measured at a freely selected position.

In the modified coating 22 according to the present embodiment, the oxygen content in the modified coating 22 is preferably from 0.5 to 2% by mass. When the oxygen content is less than 0.5% by mass, the hardness of the modified coating tends to be small. When the oxygen content is more than 2% by mass, the coating tends to fracture and the modified coating tends to detach. The oxygen is contained in the modified coating 22 in the state of an oxide of an element contained in the modified coating 22.

In the modified coating 22 according to the present embodiment, $Al_2O_3$ is present in a state of being dispersed on the surface of the modified coating 22. Since $Al_2O_3$ has a lower tendency to react with the build-up source than that of the modified coating 22, superior build-up resistance is obtained. The proportion of the area of $Al_2O_3$ on the surface of the modified coating 22 to the entire surface of the modified coating 22 is preferably from 5 to 40%. A proportion of the area of $Al_2O_3$ of lower than 5% is not favorable because the modified coating 22 becomes to have a tendency to react with the build-up source. Further, a proportion of the area of $Al_2O_3$ of higher than 40% is not favorable because $Al_2O_3$ present on the surface of the modified coating 22 becomes to have a tendency to detach.

The method employed for measuring the oxygen content in the modified coating 22 and the method employed for measuring the proportion of the area of $Al_2O_3$ on the surface of the modified coating 22 are not particularly limited, and can be measured by known methods. For example, a wavelength-dispersive electron probe micro analyzer (wavelength-dispersive EPMA) or the like may be used.

As described below, the modified coating 22 as described above is preferably formed by modifying a portion of a prescribed thickness from the surface of the thermally sprayed coating 21 by irradiating the surface of the thermally sprayed coating 21 with a laser beam having an energy density of from $1\times10^5$ to $1\times10^7$ W/cm$^2$. When the energy density is $1\times10^5$ W/cm$^2$ or less, it becomes difficult to melt the thermally sprayed coating 21, and the processing time elongates more than necessary. When the energy density is $1\times10^7$ W/cm$^2$ or more, the density of the energy with which the thermally sprayed coating 21 is melted becomes excessively high, and a modified coating 22 having a suitable thickness or cracks is not obtained even by adjustment of the prescribed conditions. In this regard, various properties, such as the thickness of the modified coating 22 to be formed, the spacing between adjacent cracks 23, the opening width of the crack 23, and the proportion of the area of $Al_2O_3$, can be regulated by adjusting the energy density of the laser employed for irradiation.

After the modified coating 22 is formed, the modified coating 22 is preferably subjected to chromate treatment. By irradiating a part or the whole of the surface of the modified coating 22 with a laser beam, the modified coating 22 can be formed at necessary portions of the thermally sprayed coating 21, which may be a part of the surface or the whole of the surface. When the modified coating 22 is formed in portions on the thermally sprayed coating 21, fine pores in regions of the thermally sprayed coating 21 that are not the modified coating 22 are preferably subjected to chromate treatment, thereby enhancing the build-up resistance by filling of the fine pores with chromium oxide. Further, cracks 23 occurring in the film surface of the modified coating 22 are preferably subjected to chromate treatment, thereby enhancing the build-up resistance thereof by filling of the cracks 23 with chromium oxide. The chromate treatment can be performed by applying or spraying a chromic acid-containing aqueous solution onto the surface of the hearth roll, and then performing heating at from 350 to 550° C. When such treatment is repeated, the coating thickness of the chromate treatment can be changed. For the purpose of filling the fine pores in the thermally sprayed coating 21 or the cracks 23 in the modified coating 21, chromate treatment conducted three times or fewer times would suffice.

(Material for Thermally Sprayed Coating)

Next, the material of the thermally sprayed coating 21 covering the hearth roll 10 will be described in detail. The inventors of the present application prepared various thermally sprayed coatings for testing, and examined the characteristics, the occurrence of build-up, and the like of the thermally sprayed coatings for testing. As the result, the inventors has found that the below-described cermet coating composed of a heat-resistant alloy and a ceramic has a large effect in terms of suppression of build-up, and a low tendency to degrade even in a long time use in a continuous annealing furnace.

The thermally sprayed coating 21 according to the present embodiment is preferably a cermet coating composed of a heat-resistant alloy and a ceramic. Here, the ceramic includes $Cr_3C_2$ at from 50 to 90% by volume, $Al_2O_3$ at from 1 to 40% by volume, $Y_2O_3$ at from 0 to 3% by volume, and $ZrB_2$ at from 0 to 40% by volume, the balance being composed of impurities and pores. $Y_2O_3$ and $ZrB_2$ are optional components (selective components), which may be incorporated as necessary.

The heat-resistant alloy includes Cr at from 5 to 20% by mass, Al at from 5 to 20% by mass, and at least one of Y or Si at from 0.1 to 6% by mass, the balance being composed of at least one of Co or Ni and impurities.

With respect to the volume ratio of the cermet coating, it is preferable that 50 to 90% by volume of the cermet coating is a ceramic, and the balance is a heat-resistant alloy.

Specific examples of the cermet coating forming the thermally sprayed coating 21 of the hearth roll according to the present embodiment will be described in detail below.

In the cermet coating, 50 to 90% by volume of the cermet coating is a ceramic, and the balance is a heat-resistant alloy, such as CoNiCrAlY, CoCrAlY, NiCrAlY, or CoNiCrAlSiY. When the proportion of ceramic is less than 50% by volume, the amount of heat-resistant alloy, which easily reacts with iron, becomes too large, and build-up tends to occur. When the proportion of ceramic exceeds 90% by volume, the coating becomes porous during thermal spraying due to the high melting point of the ceramic, and build-up sources bite in the pores and build-up tends to occur. Further, from the viewpoint of enhancing the build-up resistance, the proportion of ceramic is more preferably from 60 to 80% by volume.

Next, the material of the ceramic will be described.

The main component of the ceramic is $Cr_3C_2$, and the ceramic includes $Cr_3C_2$ at a content of from 50 to 90% by volume. $Cr_3C_2$ has little tendency to be oxidized even in high temperature environments such as in an annealing furnace, and $Cr_3C_2$ has little tendency to react with iron or manganese or oxides thereof. Therefore, $Cr_3C_2$ can prevent the occurrence of build-up. When the proportion of $Cr_3C_2$ is lower than 50% by volume, the effect in terms of suppression of build-up is not obtained, and when the proportion of $Cr_3C_2$ is higher than 90% by volume, the content of ceramic component, which suppresses diffusion of carbon, in $Cr_3C_2$ becomes relatively low, as a result of which the coating becomes fragile due to carbon diffusion. Further, from the viewpoint of enhancing the build-up resistance, the proportion of $Cr_3C_2$ is more preferably set to be from 60 to 80% by volume.

It is preferable that the particle size of $Cr_3C_2$ is, for example, from 1 to 10 μm. When the particle size of $Cr_3C_2$ is less than 1 μm, the surface area contacting with the heat-resistant alloy becomes large, and carbon diffusion tends to occur. When the particle size is more than 10 μm, the roughness of the coating surface becomes large, and iron or manganese, or an oxide thereof, tends to build up. Further, from the viewpoint of enhancing the build-up resistance, the particle size of $Cr_3C_2$ is more preferably set to be from 5 to 8 μm.

The diffusion coefficient of carbon in $Al_2O_3$ and $Y_2O_3$ is low. Therefore, $Al_2O_3$ and $Y_2O_3$ can suppress carbon contained in $Cr_3C_2$ from diffusing into the heat-resistant alloy.

In the material of the ceramic, the proportion of $Al_2O_3$ is set to be from 1 to 40% by volume, and the proportion of $Y_2O_3$ is set to be 3% by volume or less. Since $Y_2O_3$ is an optional component (selective component), which may be incorporated, if necessary, especially for purpose of obtaining an effect in terms of suppression of carbon diffusion, the amount of $Y_2O_3$ is from 0 to 3% by volume. When the proportion of $Al_2O_3$ is less than 1% by volume, an effect in terms of suppression of carbon diffusion is not obtained, and, when the proportion of $Al_2O_3$ exceeds 40% by volume, the coating becomes fragile and cracks tend to occur during use, as a result of which the build-up resistance deteriorates. Since $Y_2O_3$ has a tendency to react with manganese oxide, a $Y_2O_3$ proportion of higher than 3% by volume deteriorates the build-up resistance. When $Y_2O_3$ is incorporated in order to obtain an effect in terms of suppression of carbon diffusion, it is effective to incorporate $Y_2O_3$ at 0.5% by volume or more. With respect to $Al_2O_3$, the content of $Al_2O_3$ is more preferably set to be from 10 to 30% by volume from the viewpoint of further enhancing the build-up resistance.

$Al_2O_3$ or $Y_2O_3$ may be incorporated, in the form of an oxide, into a powder of raw materials. However, for the purpose of suppressing carbon diffusion from $Cr_3C_2$, it is preferable to oxidize Y or Al that has been incorporated in the heat-resistant alloy by oxidation treatment in the stage of raw materials, during coating or after coating, thereby allowing $Al_2O_3$ or $Y_2O_3$ to form in the surface of the heat-resistant alloy.

In a case in which the hardness of the thermally sprayed coating at high temperatures is to be enhanced for the purpose of using at high temperatures, it is preferable to incorporate $ZrB_2$, which is stable and has high hardness at high temperatures, at 40% by volume or less. When $ZrB_2$ is incorporated at more than 40% by volume, build-up tends to occur due to the build-up resistance of $ZrB_2$ being inferior to that of $Cr_3C_2$. Since $ZrB_2$ is an optional component (selective component), which may be incorporated, if necessary, especially for the purpose of use at high temperatures, the amount of $ZrB_2$ in the coating is preferably from 0 to 40% by volume. In a case in which $ZrB_2$ is incorporated for use at high temperatures, the effect in terms of enhancing the hardness at high temperatures is small with an amount of incorporated $ZrB_2$ of less than 5% by volume. Therefore, it is preferable to incorporate $ZrB_2$ at 5% by volume or more. Further, from the viewpoint of enhancing the build-up resistance, $ZrB_2$ is more preferably incorporated at from 15 to 30% by volume.

The remaining part of the above-described ceramic corresponds to impurities and pores.

Next, the material of the heat-resistant alloy will be described.

In the heat-resistant alloy, Cr is included at from 5 to 20% by mass. When Cr is included at less than 5% by mass, the oxidation resistance at high temperatures is inferior, and the coating is continuously oxidized and becomes to have a tendency to detach. At a Cr content of more than 20% by mass, the heat-resistant alloy becomes fragile and becomes to have a tendency to detach when carbonization occurs, whereas the heat-resistant alloy reacts with manganese oxide and build-up tends to occur when oxidization occurs.

The heat-resistant alloy also includes Al at from 5 to 20% by mass. When Al is included at less than 5% by mass, $Al_2O_3$ cannot be obtained in a desired amount even by conducting various oxidation treatments. When Al is included at more than 20% by mass, the hardness of the coating at high temperatures decreases and therefore there is a tendency for iron to stick into the coating and cause build-up.

Y and Si both have an effect in terms of stably forming an oxide coating and preventing detachment of the oxide coating. Either one of Y or Si, or both of Y and Si, is/are preferably incorporated at from 0.1 to 6% by mass. When Y or Si is included at more than 6% by mass, the hardness of the coating at high temperatures decreases, as a result of which there is a tendency for iron to stick into the coating and cause build-up. Y and Si is each preferably incorporated at 0.1% by mass or more, and is each more effectively incorporated at 0.5% by mass or more.

In the heat-resistant alloy, at least one of Nb at from 0.1 to 10% by mass or Ti at from 0.1 to 10% by mass is preferably incorporated. When Nb or Ti is included in the heat-resistant alloy, the Ni or Ti forms a stable carbide preferentially to the formation of carbide from Cr contained in the heat-resistant alloy, as a result of which reactions between Cr and carbon are suppressed and the coating is thereby suppressed from becoming fragile for a long time. When the content of Nb/Ti is less than 0.1% by mass, the effect in terms of suppressing reactions between Cr and carbon is not obtained. With a Nb/Ti content of more than 10% by mass, when oxidation occurs, the Nb or Ti tends to react with manganese oxide and build-up tends to occur.

The remaining part of the heat-resistant alloy described above corresponds to at least one of Co or Ni, and impurities.

One example of a scanning electron microscope (SEM) micrograph of a cross-section of the thermally sprayed coating 21 and the modified coating 22 having the configurations as described above is illustrated in FIG. 4. In the SEM micrograph illustrated in FIG. 4, a dense modified coating 22 having a small roughness is formed on the surface of the thermally sprayed coating 21, in which spaces are present. In the example illustrated in FIG. 4, the thickness of the modified coating 22 is about 5 μm. It is also seen that plural cracks are formed extending from the surface of the modified coating 22 toward the thermally sprayed coating 21.

Forming the modified coating 22 on the thermally sprayed coating 21 enables suppression of the occurrence of build-up on the hearth roll 10 in the present embodiment.

(Method of Producing Hearth Roll)

Next, a method of producing a hearth roll for a continuous annealing furnace according to the present embodiment will be described with reference to FIG. 5 and FIG. 6.

Figure 5:
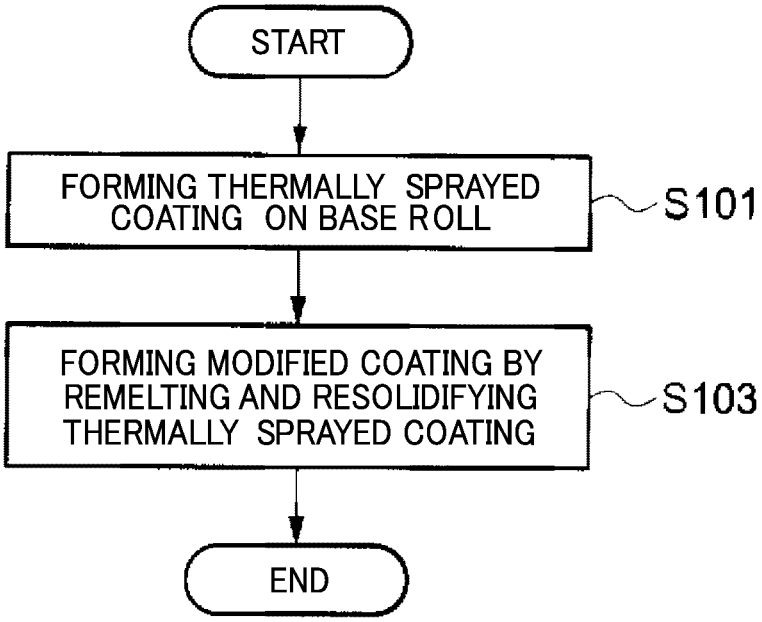
FIG. 5 is a flowchart illustrating an example of a process flow of a method of producing a hearth roll for a continuous annealing furnace according to the first embodiment.
Figure 6:
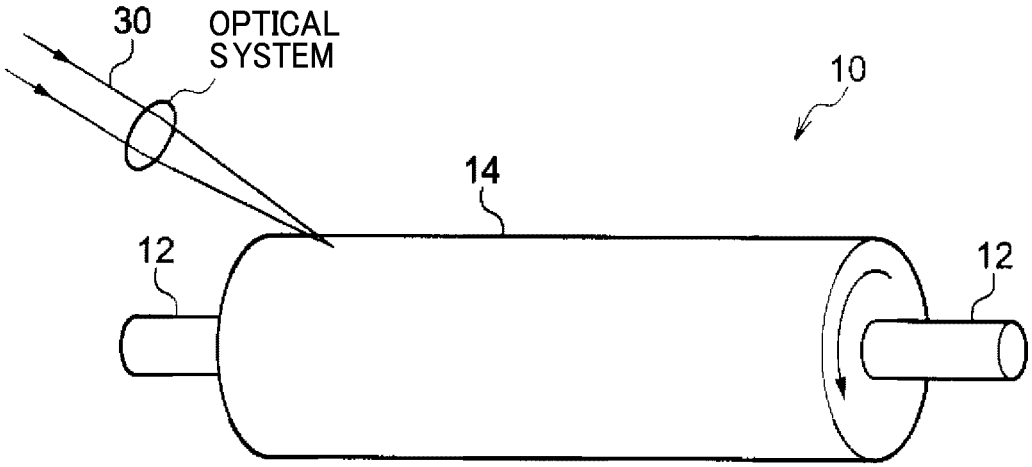
FIG. 6 is a schematic diagram illustrating a method of producing a hearth roll for a continuous annealing furnace according to the first embodiment.

In the method of producing a hearth roll according to the present embodiment, first, the thermally sprayed coating 21 is formed by thermally spraying a thermal spray material onto the circumferential surface of the base roll 20 for the hearth roll 10 (step S101), as illustrated in FIG. 5. In order to enhance the adhesive power of the thermally sprayed coating 21, known pre-thermal-spraying blasting treatments or forming of the undercoat layer 24 composed solely of a heat-resistant alloy (see FIG. 2B) may be performed, if necessary, prior to the thermal spray treatment.

The forming of the thermally sprayed coating 21 by thermal spray treatment (step S101) will be described in detail. In the thermal spray treatment, a raw material powder including a powder of the ceramic at from 50 to 90% by volume and a powder of the heat-resistant alloy as the balance, is thermally sprayed onto the surface of a base roll 20, thereby forming a cermet coating on the surface of the base roll 20. As the raw material powder to be thermally sprayed, a raw material powder in which a ceramic powder of $Cr_3C_2$, $Al_2O_3$ and the like and a heat-resistant alloy powder containing Cr and Al are mixed can be used. The thermally spraying may be performed preferably using a raw material powder in which a ceramic powder and a heat-resistant alloy powder have been combined and together granulated in advance, whereby a thermally sprayed coating 21 having higher uniformity can be formed.

With respect to a method employed for forming the thermally sprayed coating 21 on the circumferential surface of the roll, the forming is preferably carried out by performing a high velocity oxygen-fuel thermal spraying process (also referred to as "HVOF") after performing grid blasting for enhancing the adhesiveness and imparting roughness. In the HVOF, it is ordinary to use any of kerosene, $C_3H_8$, $C_2H_2$, or $C_3H_6$ as a fuel gas, and to set the pressure of the fuel gas to be from 0.1 to 1 MPa, the flow rate of the fuel gas to be from 10 to 500 L/min, the pressure of oxygen gas to be from 0.1 to 1 MPa, and the flow rate of oxygen gas to be from 100 to 1,200 L/min.

During the thermal spraying, the base roll 20 is preferably heated to be from 300° C. to 600° C. The heating may be carried out by bringing a flame of a thermal spraying gun close to the base roll 20, or by separately providing a gas burner. As a result of heating the base roll 20 to 300° C. or higher, Al and/or Y in the heat-resistant alloy is oxidized, and a desired amount of $Al_2O_3$ and/or $Y_2O_3$ can be obtained. When the heating temperature is set to be higher than 600° C., oxidation of the coating proceeds excessively and the coating becomes porous, as a result of which build-up tends to occur. Further, from the viewpoint of enhancing the build-up resistance, the range for the heating temperature is more preferably from 400 to 500° C.

In the HVOF thermal spraying, the flow rate of oxygen gas as the HVOF combustion gas component is preferably set to be from 1,000 to 1,200 L/min. When the flow rate of oxygen gas is set to be 1,000 L/min or more, Al and/or Y in the heat-resistant alloy is oxidized, whereby a desired amount of $Al_2O_3$ and/or $Y_2O_3$ can be obtained. When the flow rate of oxygen gas is set to be more than 1,200 L/min, oxidation of the raw material powder proceeds excessively during the thermal spraying and the coating becomes porous, as a result of which build-up tends to occur.

After the thermal spraying, the thermally sprayed coating 21 is preferably subjected to oxidation treatment at from 300 to 600° C. for from 1 to 5 hours. The oxidation treatment may be performed by heating the surface of the thermally sprayed coating 21 using a gas burner, or by placing the hearth roll in a furnace filled with the atmosphere or an inert gas (such as nitrogen or argon) containing a small amount oxygen and conducting heat treatment. By performing heating at 300° C. or higher for 1 hour or more, Al and/or Y in the heat-resistant alloy is oxidized, and a desired amount of $Al_2O_3$ and/or $Y_2O_3$ can be obtained. When the heating is performed at a temperature higher than 600° C. or is performed longer than 5 hours, oxidation of the coating proceeds excessively and the coating becomes porous, as a result of which build-up tends to occur. Further, from the viewpoint of enhancing the build-up resistance, the range of the heating temperature is more preferably from 400 to 500° C.

In a case in which the raw material powder is subjected to thermal spraying after the raw material powder is subjected to oxidation treatment, heat treatment is carried out at from 300 to 600° C. for from 1 to 5 hours in the atmosphere or in an inert gas (such as nitrogen or argon) containing a small amount oxygen. With a heating at a temperature of lower than 300° C. or for less than 1 hour, Y or Al is not oxidized. When the heating is performed at a temperature higher than 600° C. or performed for more than 5 hours, the amount of oxidized ceramics increases, as a result of which the melting point of the raw material powder increases and the coating becomes porous. Further, from the viewpoint of enhancing the build-up resistance, the heating temperature is more preferably set to be in the range of from 400 to 500° C.

After the thermally sprayed coating 21 is formed on the base roll 20 by the thermal spraying treatment as described above, then the surface layer of the thermally sprayed coating 21 is irradiated with a laser beam so as to cause remelting and resolidification of a portion of the thermally sprayed coating that extends from the surface layer to a prescribed depth, whereby a modified coating 22 is formed (step S103). The thickness of the modified coating 22 formed is preferably from 2 to 20 μm. The irradiation with a laser beam is preferably carried out in the atmosphere. This is because the irradiation in the atmosphere promotes oxidation reactions of metal components contained in the thermally sprayed coating 21 during irradiation with a laser beam.

Various properties concerning the thickness or cracks of the modified coating 22 to be formed can be regulated by the energy density of the laser beam used for the irradiation of the surface of the thermally sprayed coating 21. In the method of producing a hearth roll according to the present embodiment, as schematically illustrated in FIG. 6, the surface of the thermally sprayed coating 21 is irradiated in a scanning manner at a prescribed speed using a laser beam 30 emitted from a known laser emitter while the hearth roll 10 having the thermally sprayed coating 21 formed thereon is being rotated. Here, in order to regulate the laser energy density on the surface of the thermally sprayed coating 21, the degree of condensing of the laser beam 30 at the surface of the thermally sprayed coating 21 and the scanning speed are regulated using known optical systems.

Although it is preferable to set the energy density of the laser beam used for irradiation of the surface of the thermally sprayed coating 21 to be from $1\times10^5$ to $1\times10^7$ W/cm$^2$, the degree of light condensing or the scanning speed is not particular restricted. For example, irradiation with a laser beam may be performed under the following conditions. Specifically, the surface of the thermally sprayed coating 21 is irradiated by one time or plural times scanning with a laser beam having an output power of 1,000 W and condensed to a diameter of 300 μm at the surface of the thermally sprayed coating 21 (energy density: about $1.4\times10^6$ W/cm$^2$), at a scanning speed of 10 m/s and a pitch of 50 μm using a Nd/YAG laser device (laser wavelength: 1,064 nm). Performing remelting and resolidification of the thermally sprayed coating 21 under the conditions as described above enables the modified coating 22 as described to be formed. The process conditions described above are merely one example, and the process conditions, such as the degree of light condensing, the scanning speed, the pitch, and the number of times of scanning, may be selected, as appropriate, in accordance with the wavelength or output power of the laser to be used, such that the thickness of the modified coating 22 becomes to be preferably from 2 to 20 μm.

Although a Nd/YAG laser (laser wavelength: 1064 nm) is used in the above, near-infrared lasers having a laser wavelength within the range of from 900 to 1,100 nm are preferably used, such as a Yb-based fiber laser (laser wavelength: 1,070 nm) and a disk laser (laser wavelength: 1,030 nm). Beside laser beams, it is also possible to use, for example, an electron beam. Laser beams and electron beams are examples of energy beams.

By the above-described processes, the hearth roll for a continuous annealing furnace according to the present embodiment can be produced.

In the above, the hearth roll for a continuous annealing furnace according to the present embodiment and a method of producing the hearth roll have been described. According to the present embodiment, a dense and highly strong modified coating that appropriately regulates the surface roughness of the roll circumferential surface of the hearth roll 10 can be provided, whereby attachment of contaminating objects, such as iron or manganese oxide, to the roll circumferential surface can be remarkably reduced. Therefore, attachment and growing of contaminating objects that are carried with the steel sheet 2 being conveyed, to the roll circumferential surface of the hearth roll 10 (i.e., occurrence of build-up) can be suppressed during the operation of the continuous annealing furnace 1. This enables prevention or suppression of the generation of transferred defects on the steel sheet 2 caused by the build-up, and the quality of the steel sheet 2 can be improved.

Further, since the hearth roll 10 can be used stably for a long time in a high temperature environment in the continuous annealing furnace 1, the lifetime of the hearth roll 10 can be greatly prolonged. Moreover, in scheduled maintenance of the continuous annealing furnace 1, the necessity of the operation to remove objects attaching to the roll surface of the hearth roll 10 disappears or is remarkably reduced, whereby the efficiency of the production of the steel sheet 2 in the continuous annealing furnace 1 can be increased.

EXAMPLES

Next, examples will be described. The following examples indicate the results of tests carried out for demonstrating the effect of the invention, but the invention is not limited to the following examples.

Plural kinds of hearth rolls 10 were produced according to the above-described method of producing a hearth roll, and measurements were carried out in which each hearth roll 10 was used in a continuous annealing furnace 1 and the lifetime of each hearth roll 10 was measured With respect to the lifetime of the roll, the roll circumferential surface of the hearth roll 10 was measured using a portable fluorescence X-ray in a continuous annealing furnace 1 that is online, and the point of time at which the amount of iron (Fe) attaching to the roll circumferential surface exceeds 5% by mass is taken as the expiry of the lifetime. The roll diameter ϕ in the present embodiment was set to 1,000 mm.

In the remelting and resolidifying treatment of the thermally sprayed coating 21, the composition of the thermally sprayed coating or the surface roughness also exert an influence, and, therefore, the remelting and resolidifying treatment is performed while appropriately adjusting the degree of light condensing and the scanning speed. For example, in the case of a thermally sprayed coating indicated in Table 1 having a Vickers hardness HV of 950 and including ceramic at 80% by volume of the thermally sprayed coating ($Cr_3C_2$ at 79% by volume and $Al_2O_3$ at 1% by volume) and the remaining part composed of a heat-resistant alloy that includes, in terms of % by mass, Cr at 10%, Al at 5%, Y at 2%, Ti at 0.1%, and Co as the balance, one time scanning treatment at a pitch of 50 μm and a scanning speed of 10 m/s performed using a laser beam from a Nd/YAG laser device having an output power of 1,000 W condensed to a diameter of 300 μm at the surface of the thermally sprayed coating 21 resulted in a thickness of the modified coating 22 of 11 μm as determined by measurement of a simultaneous test specimen. When the scanning treatment was performed twice under the same conditions, a thickness of the modified coating 22 of 13 μm was obtained. With a degree of light condensation of 1,000-μm diameter under the same conditions, one time scanning resulted in a thickness of the modified coating 22 of 2 μm. When one-time scanning treatment was performed with an output power of 500 W, light condensation to 300-μm diameter, a pitch of 60 μm, and a scanning speed of 8 m/s, the thickness of the modified coating 22 was 8 μm. Therefore, in the examples indicated in Table 1, the degree of light condensation, the scanning speed, the pitch, and the number of times of scanning, were designed, as appropriate, based on the above findings, thereby preparing modified coatings 22 having the thicknesses indicated in Table 1

The composition of the thermally sprayed coating 21 formed on the roll circumferential surface, and the properties of the thermally sprayed coating 21 and the modified coating 22 are collectively indicated in Table 1.

In Table 1, the thickness, crack spacing, and crack width of the modified coating 22 were measured by observing a cross-section of an obtained hearth roll simultaneous sample with a SEM. The crack spacings and the crack widths were measured in 10 visual fields in the cross-section observed with the SEM at a measurement magnification of 1,000 fold, and the average value thereof was calculated. As for the proportion of the areas of $Al_2O_3$ at the surface of the modified coating 22, surface images of 10 visual fields were obtained using a wavelength-dispersive EPMA at a measurement magnification of 500 fold, and backscattered electron images were binarized such that areas determined as $Al_2O_3$ by a qualitative analysis were colored white and such that the other areas were colored black, thereby determining the proportions of the $Al_2O_3$ area, and the average value of the area proportions was calculated. As for the oxygen content of the modified coating 22, quantitative analysis was performed on the 10 visual fields observed using a wavelength-dispersive EPMA at a measurement magnification of 500 fold, thereby determining the oxygen contents, and the average value of the oxygen contents was calculated. Further, the Vickers hardnesses HV of the thermally sprayed coating 21 and the modified coating 22 were measured according to the method defined in ISO 6507-1, and the hardness change ratio obtained by (Vickers hardness HV of modified coating 22/Vickers hardness HV of thermally sprayed coating 21) is also indicated in Table 1. Further, the roll lifetime, which was obtained as a test result, is also indicated in Table 1.

TABLE 1

| | | Modified Coating | | | | | | |
|---|---|---|---|---|---|---|---|---|
| | | Thickness (μm) | Hardness Hv | Crack Spacing (μm) | Crack Width (μm) | Proportion of Area of $Al_2O_3$ (%) | Oxygen Content (% by mass) | Thermally Sprayed Coating Hardness Hv |
| Examples | 1 | 2 | 1250 | 20 | 1.0 | 6 | 0.5 | 950 |
| | 2 | 4 | 1330 | 40 | 1.8 | 6 | 0.4 | 950 |
| | 3 | 2 | 1300 | 40 | 1.8 | 6 | 0.4 | 950 |
| | 4 | 10 | 1300 | 40 | 1.8 | 6 | 0.4 | 950 |
| | 5 | 20 | 1300 | 40 | 1.8 | 6 | 0.4 | 950 |
| | 6 | 10 | 1140 | 40 | 1.8 | 6 | 0.4 | 950 |
| | 7 | 10 | 1300 | 40 | 1.8 | 6 | 0.4 | 950 |
| | 8 | 10 | 1330 | 40 | 1.8 | 6 | 0.4 | 950 |
| | 9 | 10 | 1140 | 100 | 4.2 | 6 | 0.5 | 950 |
| | 10 | 20 | 1150 | 150 | 5.6 | 6 | 0.4 | 950 |
| | 11 | 7 | 1300 | 55 | 2.8 | 6 | 0.5 | 950 |
| | 12 | 5 | 1320 | 40 | 1.8 | 6 | 0.6 | 950 |
| | 13 | 15 | 1160 | 120 | 5.2 | 6 | 0.5 | 950 |
| | 14 | 18 | 1150 | 140 | 4.8 | 6 | 0.5 | 950 |
| | 15 | 5 | 1100 | 40 | 2.0 | 24 | 5.0 | 880 |
| | 16 | 11 | 1000 | 60 | 3.0 | 16 | 3.0 | 750 |
| | 17 | 20 | 800 | 100 | 4.0 | 22 | 9.0 | 600 |
| | 18 | 2 | 1310 | 10 | 0.1 | 10 | 0.5 | 1000 |
| | 19 | 2 | 1150 | 5 | 0.1 | 40 | 9.0 | 900 |
| | 20 | 20 | 800 | 150 | 5.0 | 6 | 2.0 | 630 |
| | 21 | 18 | 800 | 100 | 4.0 | 10 | 4.5 | 620 |
| | 22 | 16 | 850 | 100 | 3.0 | 6 | 4.0 | 650 |
| | 23 | 18 | 850 | 100 | 4.0 | 10 | 3.5 | 650 |
| | 24 | 15 | 800 | 100 | 4.0 | 5 | 4.1 | 660 |
| Comparative Examples | 1 | 60 | 430 | 300 | 10.0 | 15 | 20 | 400 |
| | 2 | 1 | 1300 | 40 | 1.8 | 1.2 | 0.4 | 950 |
| | 3 | 30 | 1300 | 40 | 1.8 | 1.2 | 0.4 | 950 |
| | 4 | 10 | 1100 | 40 | 1.8 | 1.2 | 0.4 | 950 |
| | 5 | 10 | 1400 | 40 | 1.8 | 1.2 | 0.4 | 950 |
| | 6 | 1 | 1200 | 5 | 0.2 | 1 | 0.5 | 950 |
| | 7 | 30 | 1300 | 100 | 1.0 | 1 | 0.5 | 950 |
| | 8 | 40 | 550 | 200 | 8.0 | 1 | 1.4 | 500 |
| | 9 | 0 | 550 | 0 | 0.0 | 0 | 0 | 500 |
| | 10 | 30 | 400 | 150 | 5.0 | 12 | 22.0 | 450 |
| | 11 | 35 | 430 | 180 | 7.0 | 45 | 10.0 | 500 |

| | | Thermally Sprayed Coating | | | | |
|---|---|---|---|---|---|---|
| | | Proportion of Ceramic in Coating (% by volume) | Proportions of Components in Heat-resistant Alloy (% by mass) | Chromate Treatment | Hardness Change Ratio | Roll Lifetime (years) |
| Examples | 1 | $79Cr_3C_2$—$1Al_2O_3$ | Bal. Co—10Cr—5Al—2Y—0.1Ti | Yes | 1.32 | 4.8 |
| | 2 | $79Cr_3C_2$—$1Al_2O_3$ | Bal. Co—10Cr—5Al—2Y—0.1Ti | Yes | 1.40 | 4.7 |
| | 3 | $79Cr_3C_2$—$1Al_2O_3$ | Bal. Co—10Cr—5Al—2Y—0.1Ti | Yes | 1.37 | 4.7 |
| | 4 | $79Cr_3C_2$—$1Al_2O_3$ | Bal. Co—10Cr—5Al—2Y—0.1Ti | Yes | 1.37 | 4.7 |
| | 5 | $79Cr_3C_2$—$1Al_2O_3$ | Bal. Co—10Cr—5Al—2Y—0.1Ti | Yes | 1.37 | 4.7 |
| | 6 | $79Cr_3C_2$—$1Al_2O_3$ | Bal. Co—10Cr—5Al—2Y—0.1Ti | Yes | 1.20 | 4.7 |
| | 7 | $79Cr_3C_2$—$1Al_2O_3$ | Bal. Co—10Cr—5Al—2Y—0.1Ti | Yes | 1.37 | 4.7 |
| | 8 | $79Cr_3C_2$—$1Al_2O_3$ | Bal. Co—10Cr—5Al—2Y—0.1Ti | Yes | 1.40 | 4.7 |
| | 9 | $79Cr_3C_2$—$1Al_2O_3$ | Bal. Co—10Cr—5Al—2Y—0.1Ti | Yes | 1.20 | 4.9 |
| | 10 | $79Cr_3C_2$—$1Al_2O_3$ | Bal. Co—10Cr—5Al—2Y—0.1Ti | Yes | 1.21 | 4.6 |
| | 11 | $79Cr_3C_2$—$1Al_2O_3$ | Bal. Co—10Cr—5Al—2Y—0.1Ti | Yes | 1.37 | 4.9 |
| | 12 | $79Cr_3C_2$—$1Al_2O_3$ | Bal. Co—10Cr—5Al—2Y—0.1Ti | Yes | 1.39 | 5.0 |
| | 13 | $79Cr_3C_2$—$1Al_2O_3$ | Bal. Co—10Cr—5Al—2Y—0.1Ti | Yes | 1.22 | 4.7 |
| | 14 | $79Cr_3C_2$—$1Al_2O_3$ | Bal. Co—10Cr—5Al—2Y—0.1Ti | Yes | 1.21 | 4.6 |
| | 15 | $56Cr_3C_2$—$14Al_2O_3$ | Bal. Co—20Cr—20Al—2Y | Yes | 1.25 | 4.4 |
| | 16 | $54Cr_3C_2$—$6Al_2O_3$ | Bal. Co—20Cr—20Al—3Y | Yes | 1.33 | 4.3 |
| | 17 | $30Cr_3C_2$—$20Al_2O_3$ | Bal. Co—5Cr—5Al—1Y | Yes | 1.33 | 4.0 |
| | 18 | $89Cr_3C_2$—$1Al_2O_3$ | Bal. Co—10Cr—10Al—2Y—5Ti | Yes | 1.31 | 5.0 |
| | 19 | $45Cr_3C_2$—$43Al_2O_3$—$2Y_2O_3$ | Bal. Co—15Cr—15Al—0.1Y—10Nb | Yes | 1.28 | 3.9 |
| | 20 | $34Cr_3C_2$—$15ZrB_2$—$1Al_2O_3$ | Bal. Co—10Cr—5Al—0.1Si | No | 1.27 | 3.5 |
| | 21 | $29.5Cr_3C_2$—$20ZrB_2$—$0.5Al_2O_3$ | Bal. Co—20Cr—20Al—6Si—10Ti | No | 1.29 | 3.8 |
| | 22 | $28Cr_3C_2$—$20ZrB_2$—$1Al_2O_3$—$1Y_2O_3$ | Bal. Ni—10Cr—10A1—6Y—0.1Nb | Yes | 1.31 | 3.9 |
| | 23 | $29Cr_3C_2$—$10Al_2O_3$—$1Y_2O_3$ | Bal. Co—15Cr—15Al—1Y—5Nb | Yes | 1.31 | 4.4 |
| | 24 | $40ZrO_2$—$10Y_2O_3$ | Bal. Co—15Cr—15Al—1Y | No | 1.21 | 3.0 |
| Comparative Examples | 1 | $20Cr_3C_2$ | Bal. Co—20Cr—30Al | Yes | 1.08 | 0.9 |
| | 2 | $79Cr_3C_2$—$1Al_2O_3$ | Bal. Co—10Cr—5Al—2Y—0.1Ti | Yes | 1.37 | 0.6 |
| | 3 | $79Cr_3C_2$—$1Al_2O_3$ | Bal. Co—10Cr—5Al—2Y—0.1Ti | Yes | 1.37 | 0.5 |
| | 4 | $79Cr_3C_2$—$1Al_2O_3$ | Bal. Co—10Cr—5Al—2Y—0.1Ti | Yes | 1.16 | 1.5 |
| | 5 | $79Cr_3C_2$—$1Al_2O_3$ | Bal. Co—10Cr—5Al—2Y—0.1Ti | Yes | 1.47 | 1.6 |
| | 6 | $79Cr_3C_2$—$1Al_2O_3$ | Bal. Co—10Cr—5Al—2Y—0.1Ti | Yes | 1.26 | 0.9 |
| | 7 | $79Cr_3C_2$—$1Al_2O_3$ | Bal. Co—10Cr—5Al—2Y—0.1Ti | Yes | 1.37 | 0.9 |

TABLE 1-continued

| | | | | | |
|---|---|---|---|---|---|
| 8 | $30Cr_3C_2$ | Bal. Co—20Cr—2Al | Yes | 1.10 | 1.2 |
| 9 | $30Cr_3C_2$ | Bal. Co—20Cr—10Al | Yes | — | 1.5 |
| 10 | $30Al_2O_3$ | Bal. Co—20Cr—2Al | No | 0.89 | 1.9 |
| 11 | $450Al_2O_3$ | Bal. Co—20Cr—2Al | No | 0.86 | 1.8 |

As is clear from Table 1, it is clear that the hearth rolls according to Examples 1 to 24 include the modified coating 22 having a high Vickers hardness HV and have excellent roll lifetime. In particular, it is seen that examples in which the values of the crack spacing, the crack width, and the proportion of the area of $Al_2O_3$ are appropriate values have especially superior roll lifetimes. These results demonstrate that occurrence of build-up is suitably suppressed when a hearth roll is produced using the method of producing a hearth roll according to the present specification.

In contrast, the hearth rolls according to the comparative examples exhibited a roll lifetime of less than 2 years, demonstrating that the hearth rolls according to the comparative examples did not succeed in suppressing the occurrence of build-up on the surface of the hearth rolls.

The disclosure of Japanese Patent Application No. 2014-204108, filed Oct. 2, 2014, is incorporated herein by reference in its entirety.

All publications, patent applications, and technical standards mentioned in this specification are herein incorporated by reference to the same extent as if each individual publication, patent application, or technical standard was specifically and individually indicated to be incorporated by reference.

Although typical embodiments have been described above, the invention is not limited to such embodiments. It is intended that the scope of the invention be defined by the following claims.

The invention claimed is:

1. A hearth roll, comprising:

a base roll;

a thermally sprayed coating formed on the base roll; and a modified coating formed on the thermally sprayed coating, the modified coating being formed by modifying a part or the whole of a surface of the thermally sprayed coating by melting and solidification of the thermally sprayed coating, by irradiating a part or the whole of the surface of the thermally sprayed coating with an energy beam, a thickness of the modified coating being from 2 to 20 μm, and a Vickers hardness HV of the modified coating being from 1.2 to 1.4 times larger than a Vickers hardness HV of the thermally sprayed coating.

2. The hearth roll according to claim 1, wherein cracks are present on a surface of the modified coating, and an average spacing between adjacent cracks in a cross-section of the hearth roll cut in a thickness direction is from 10 to 100 μm, and opening widths of the cracks are less than 5 μm.

3. The hearth roll according to claim 1, wherein the modified coating comprises from 0.5% to 2% by mass of oxygen.

4. The hearth roll according to claim 1, wherein $Al_2O_3$ is present in a dispersed state in a surface of the modified coating, and a proportion of an area of $Al_2O_3$ in the surface of the modified coating is from 5% to 40%.

5. The hearth roll according to claim 1, further comprising a chromium oxide layer formed on the modified coating, or on the modified coating and the thermally sprayed coating.

6. The hearth roll according to claim 1, wherein the thermally sprayed coating is a cermet coating consisting of a heat-resistant alloy and a ceramic, the ceramic including, in terms of % by volume, $Cr_3C_2$ at from 50% to 90%, $Al_2O_3$ at from 1% to 40%, $Y_2O_3$ at from 0% to 3%, and $ZrB_2$ at from 0% to 40%, and the balance being composed of impurities and pores, the heat-resistant alloy including, in terms of % by mass, Cr at from 5% to 20%, Al at from 5% to 20%, and at least one of Y or Si at from 0.1% to 6%, and the balance being composed of at least one of Co or Ni and impurities, and from 50 to 90% by volume of the cermet coating being the ceramic, and the balance being the heat-resistant alloy.

7. The hearth roll according to claim 6, wherein the heat-resistant alloy further includes, in terms of % by mass, at least one of Nb at from 0.1 to 10% or Ti at from 0.1 to 10%.

8. A method of producing the hearth roll according to claim 1, comprising a step of irradiating a part or the whole of a surface of a thermally sprayed coating formed on the base roll with an energy beam, thereby modifying a part or the whole of the surface of the thermally sprayed coating by melting and solidification of the thermally sprayed coating, to form a modified coating having a thickness of from 2 to 20 μm and a Vickers hardness HV that is from 1.2 to 1.4 times larger than the Vickers hardness HV of the thermally sprayed coating.

9. The method of producing a hearth roll according to claim 8, wherein the irradiating with the energy beam is performed in the atmosphere.

10. The method of producing a hearth roll according to claim 8, wherein a chromate treatment is performed after the modified coating is formed.

* * * * *